United States Patent [19]

Keuchel et al.

[11] 4,009,812

[45] Mar. 1, 1977

[54] FIBRILLATOR

[75] Inventors: Herbert W. Keuchel, Tallmadge; George A. Farris, North Canton, both of Ohio

[73] Assignee: PNC Corporation, Wycoff, N.J.

[22] Filed: Oct. 3, 1975

[21] Appl. No.: 619,313

[52] U.S. Cl. ..... 225/97; 83/168

[51] Int. Cl.[2] ..... B26F 3/02

[58] Field of Search ..... 225/3, 93, 97, 106; 83/660, 672, 678, 444, 448, 450, 431, 168, 169; 264/147, 160, DIG. 8; 28/54, DIG. 1

[56] References Cited

UNITED STATES PATENTS

| | | | |
|---|---|---|---|
| 3,526,349 | 9/1970 | Moro | 225/97 |
| 3,547,329 | 12/1970 | Kalwaites | 225/97 |
| 3,684,142 | 8/1972 | Jackson | 225/97 |
| 3,925,864 | 12/1975 | Gilpatrick | 83/678 X |

FOREIGN PATENTS OR APPLICATIONS

| | | | |
|---|---|---|---|
| 1,042,156 | 6/1953 | France | 28/54 |
| 943,062 | 11/1963 | United Kingdom | 28/54 |

*Primary Examiner*—Frank T. Yost
*Attorney, Agent, or Firm*—John E. Benoit

[57] ABSTRACT

A mechanical fibrillator for use with a split film tape extrusion system which comprises means for guiding the tape through the fibrillator, rotating cutter means in the fibrillator, means for forcing the tape into contact with the rotating cutter means, and means adjacent the cutter for collecting dust created during fibrillation.

8 Claims, 12 Drawing Figures

FIBRILLATOR

This invention relates generally to mechanical fibrillators and more specifically to mechanical fibrillators for use in a slit film tape extrusion system.

It is well known that many synthetic organic polymers have properties which when highly oriented make them easily fibrillated by the application of various forces such as mechanical forces. These polymers have the necessary crystalline properties so as to form a thin film by the extrusion process. When these films are stretched or drawn in various ways, there is a resultant parallel orientation of the long chain of molecules. These films may be subsequently fibrillated by various techniques such as the application of a stress transverse the direction of orientation, mechanical forces applied in a beating fashion, the slitting of film with cutting blades, etc.

It is further well known to provide a thin film as described above which is then oriented and then which is silt into a plurality of substantially parallel tapes. These tapes may then be subjected to fibrillation by various means.

It is an object of this invention to combine within a slit film processing unit a mechanical fibrillator for fibrillating the individual tapes produces by the slit film process.

It is a further object of this invention to provide mechanical fibrillation using cutting blades provided as an integral part of a rotating rod extending across the transverse direction of the tapes.

It is a further object of this invention to provide a mechanical fibrillator in a slit film process wherein a dust collection means is incorporated within the fibrillator itself.

Yet another object of this invention is to provide a mechanical fibrillator within a slit film system wherein the means for maintaining the tapes in a position, adjacent the cutting device is adjustable.

Still another object of this invention is to provide a fibrillator within a slit film system wherein the fibrillator incorporates means for aligning and separating the tapes formed within the slit film system prior to and subsequent to fibrillation.

A still further object of this invention is to provide a film cutting or scoring device which gradually engages the film tapes so as to reduce dust formation during fibrillation.

Another object of this invention is to use a multifluted, helical cutting or scoring device to reduce tape and machine vibrations by elimination of shock loading of the tapes and the drive.

These and other objects of the invention will be more clearly understood from the following description taken together with the drawings wherein.

Figure 1:
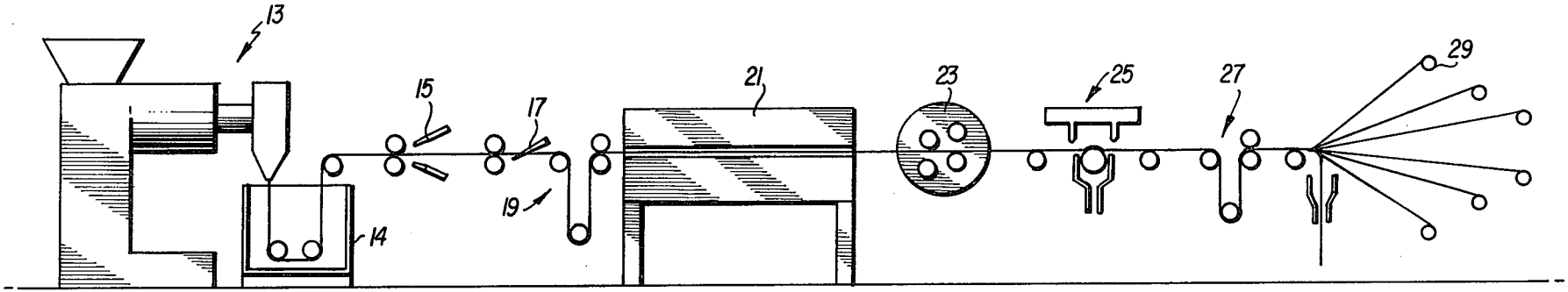
FIG. 1 is a schematic representation of a slit film extrusion system incorporating the fibrillator of the present invention.

Broadly speaking, the present invention provides a mechanical fibrillator for use with a split film tape extrusion system which comprises means for guiding said tape through the fibrillator, rotating cutter means in said fibrilltor, means for forcing said tape into contact with said rotating cutter means, and means adjacent said cutter for collecting dust created during fibrillation.

Turning now specifically to the drawings, there is shown a split film tape extrusion system comprised of an extruder 13 with the film extrudate passing through a bath 14 for quenching purposes, and then through an air system 15. After the tape is thus quenched and cooled, it passes through a slitter 17 and pulled by a godet 19 and into an oven 21 where it is subjected to stretching and oriention by the second godet 27.

The oriented film passes through a delustering unit 23 and then through the fibrillator 25 of the present invention. After fibrillation it is pulled through the second godet and is then delivered to the various take up rolls 29.

Figure 2:
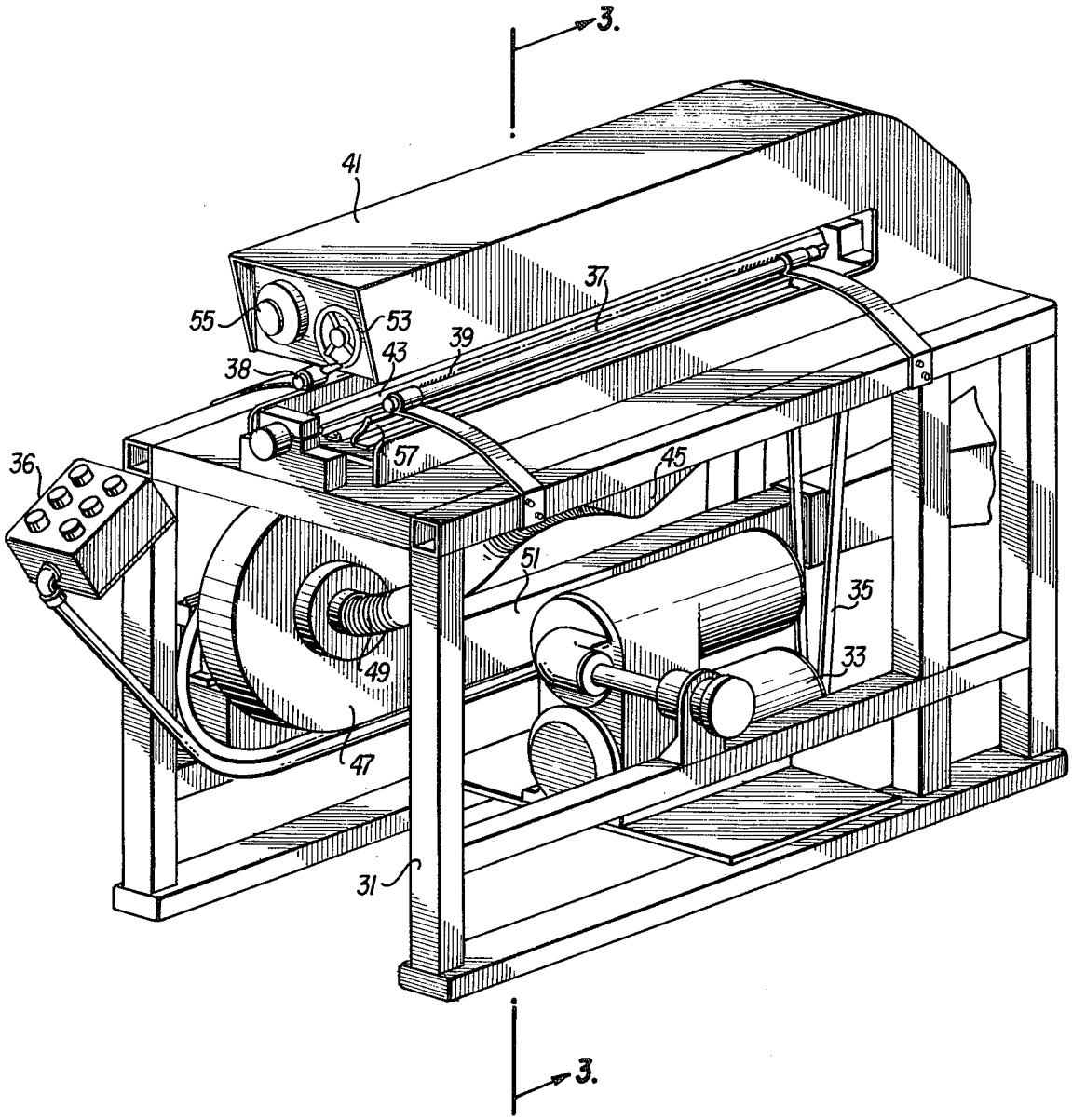
FIG. 2 is a perspective view of one embodiment of the fibrillator of the present invention.

Turning now to FIG. 2, there is shown one embodiment of an assembled fibrillator. The machine is mounted on a stand 31 on which is mounted motor 33 which drives a belt 35 which in turn passes around the cutter element 43 to drive it. This motor is a variable speed motor and may be controlled from the control panel 36.

Two guide bars 37 and 38 are provided on either side of the cutter mechanism 43. These guide bars include pins 39 as shown more clearly in FIGS. 4 and 5.

A shroud 41 surrounds the retractable guide thus providing a cover therefore. There is also provided a manifold 45 connected to a suction fan 47 by means of a flexible conduit 49. This manifold is mounted below the primary dust collection system adjacent to the cutter which will be described in detail later. A suction fan passes the collected dust through a conduit 51 outwardly of the machine itself where it is collected.

The manual controls include a height adjusting wheel 53 and a height indicator dial mechanism 55 as will be apparent as the description proceeds.

Figure 3:
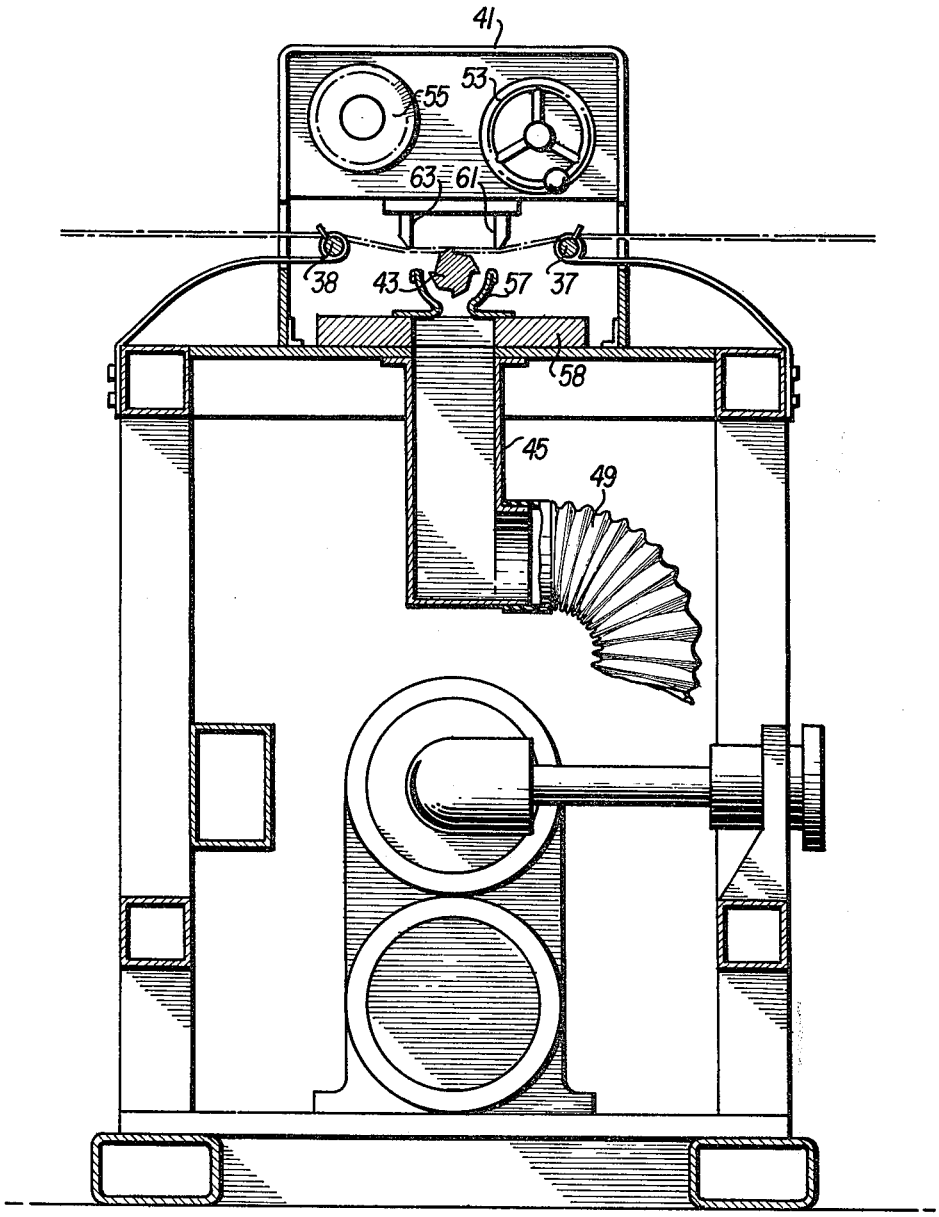
FIG. 3 is a sectional view taken along lines 3—3 of FIG. 2.

FIG. 3 illustrative of the cutter mechanism guide bars and dust collector. The primary element of the dust collector is channel 57 which extends the length of the cutter and forms a Venturi channel with the sides of the channel extending upwardly and substantially enclosing one half the circumference of the cutter. The dust created by the fibrillation is drawn in to the manifold 45 by a Venturi effect and then blown out of the manifold through hose 49.

There is also shown in FIG. 3 an end view of the fibrillator guide members 61 and 63 which are adjustable in height and in horizontal position. The height adjustment is controlled by wheel 53 with an indicator dial 55 geared thereto as more clearly shown in FIG. 7. The path of the tapes is indicated by the dashed line.

Figure 4:
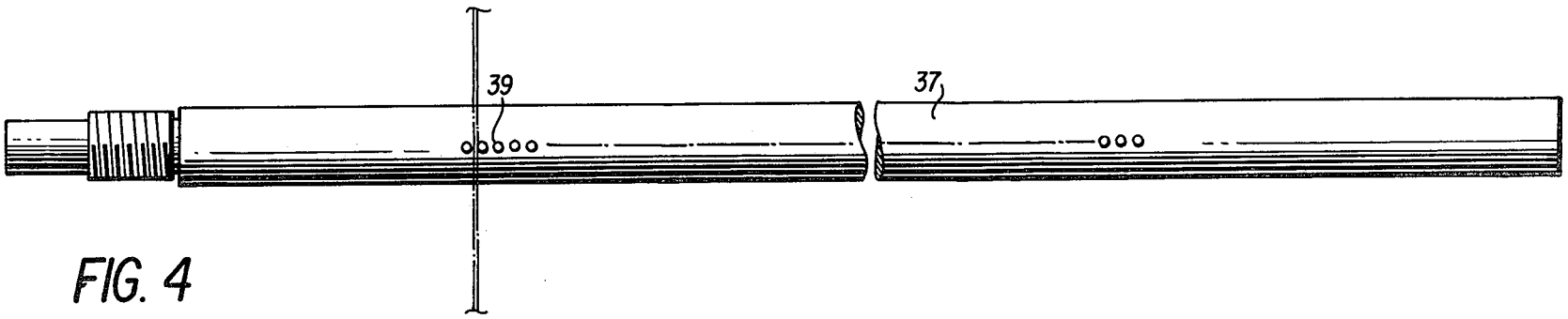
FIG. 4 is an elevational view of the tape guide bar used in the apparatus of FIG. 2.
Figure 5:
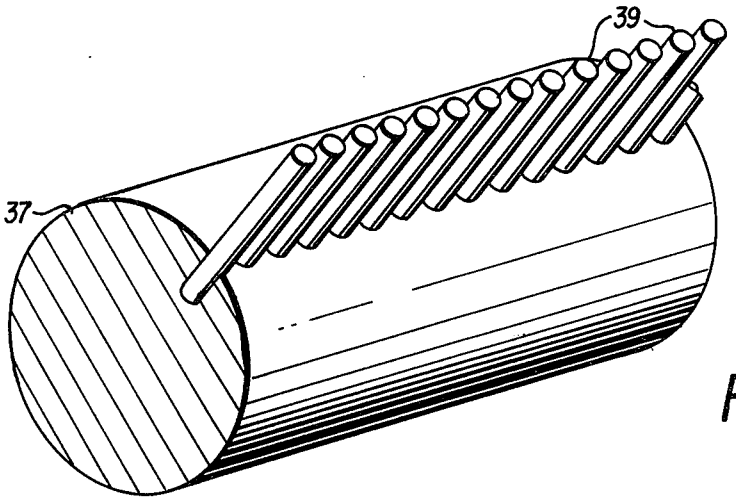
FIG. 5 is a partial sectional perspective view, in an enlarged form, of a section of the guide of FIG. 3.

FIGS. 4 and 5 show the details of the guide bar members which may be mounted as shown in the drawings or could be mounted by any known supporting device which could be adjustable if so desired. The guide bar 37 includes spaced pins 39 extending along the length thereof. The slit tape is fed to the input guide bar with each individual tape being between adjacent pins. As the tapes pass outwardly of the fibrillator past the cutter, the pass the pins in the exiting tape guide bar member.

Figure 6:
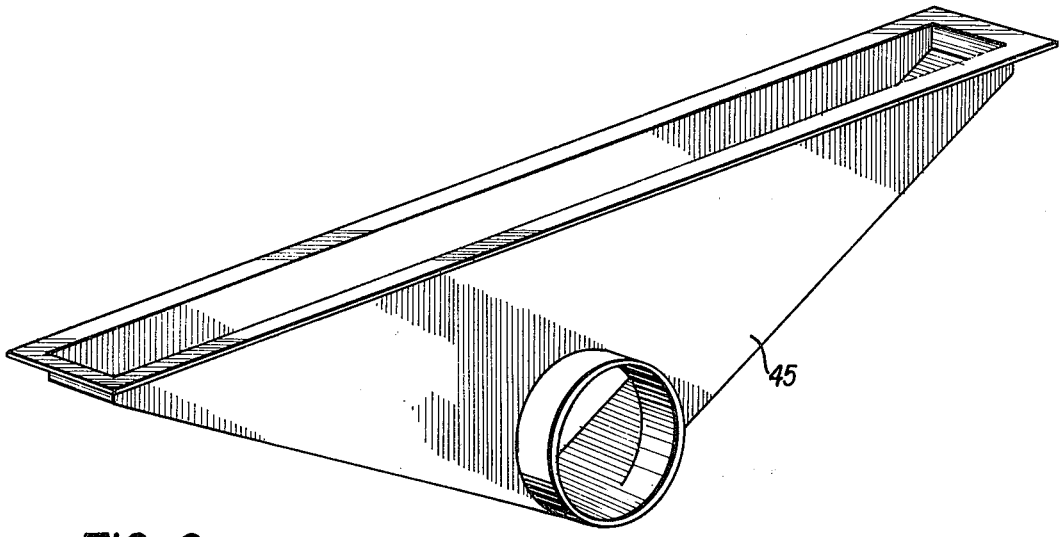
FIG. 6 is a perspective view of the manifold used with the dust collector system of the present invention.

FIG. 6 is a perspective view of the manifold 45 having its input channel mounted adjacent to the lower part of the area formed by the Venturi 57 as shown in FIG. 3.

Figure 7:
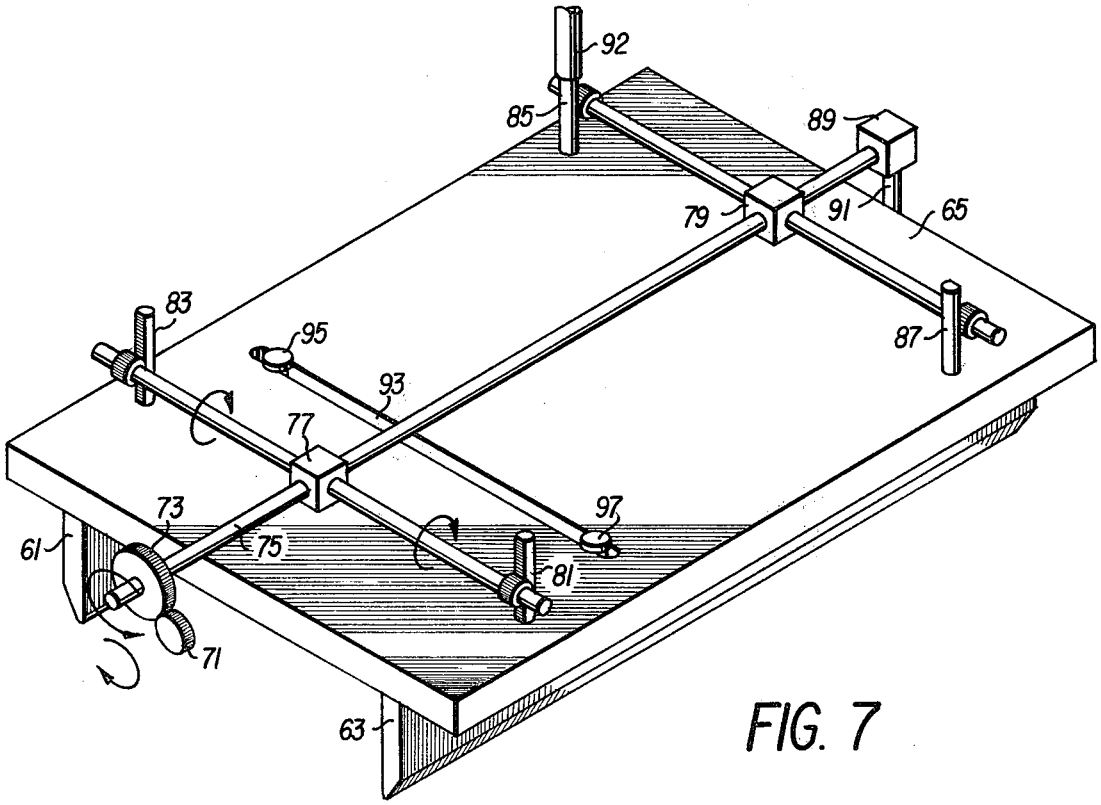
FIG. 7 is a perspective diagrammatic view of the mechanism for adjusting the height of the tape with relation to the cutting blades.

FIG. 7 shows diagramatically the mechanism for adjusting the position of the fibrillating guide members 61 and 63. These guide members are mounted on a base 65. A gear 71 meshes with a gear 73 so as to rotate the shaft 75 through gear boxes 77 and 70. These gear boxes in turn rotate the shafts extending therefrom so as to move the pinion part of the rack and pinion mechanisms 81, 83, 85, and 87. The racks are securely mounted to the base 65, and therefore, the height of the base is dependent upon the control of the pinion as provided through the input gear 71. Indicator dial 55 (FIG. 3) is attached to the shaft of gear 73.

The other end of shaft 75 is supported in a bearing mount 89 which is supported by a mounting structure 91. Thus, the entire assembly is supported by a cantilevered construction with the gearing supplying the individual support. The rack portions of the rack and pinion mechanisms extend upwardly into tubular members 92 which are secured within the shroud 41 and extend downwardly therefrom. For purposes of clarity, only one such tubular member is shown. The tubular members act as a guide and also prevent tipping and misalignment of the entire assembly.

There is further provided a slot 93 through the base 65 and associated pins 95 and 97. The pins are mounted to a plate (not shown) which is in turn mounted between guide members 61 and 63 below base 65. Thus, the Guides 61 and 63 may be manually adjusted horizontally within the limits determined by the length of the slot and the position of the pins.

Figure 11:
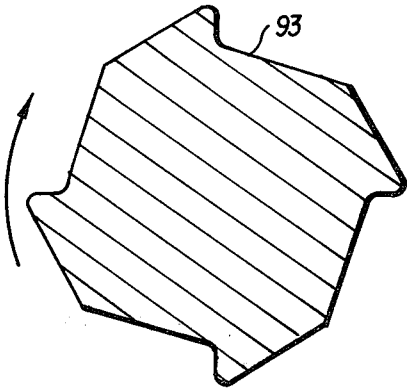
FIG. 11 is a sectional view similar to FIG. 10 showing a different cutter edge configuration.
Figure 10:
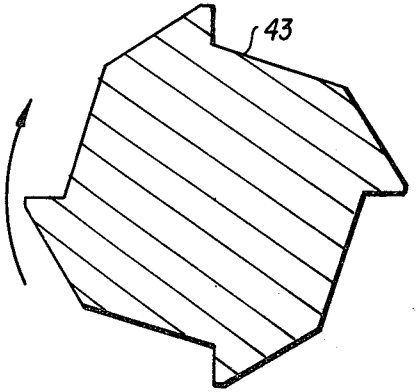
FIG. 10 is a sectional view taken along lines 10—10 of FIG. 8.
Figure 8:
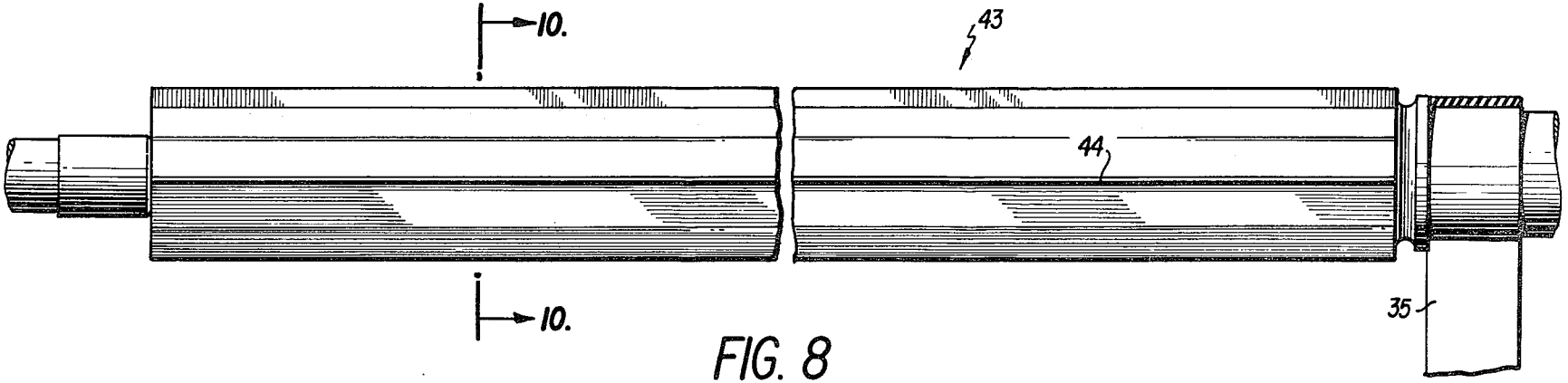
FIG. 8 is a partial view of one of the cutters used with the present invention.

FIG. 8 shows a cutter 43 having extending therealong about the circumference thereof the sharp cutting edges 44. A cross sectional view of this blade is shown in FIG. 10 wherein the cutting edges terminate in a relatively sharp cutting edge extending the length of the rod. If desired the sharp cutting edges may be rounded as shown in FIG. 11 on the rod 93. The particular configuration of the cutting edges will determine the type and degree of fibrillation which occurs. Round or gradual penetration of the cutting edge will reduce dust formation and vibration.

Figure 12:
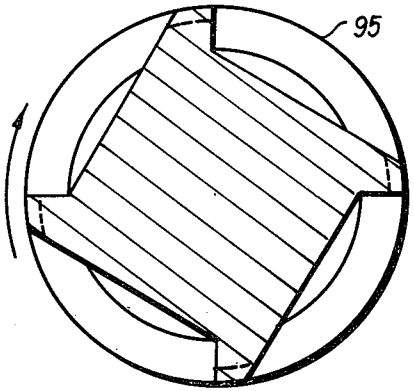
FIG. 12 is a sectional view taken along lines 12—12 of FIG. 9.
Figure 9:
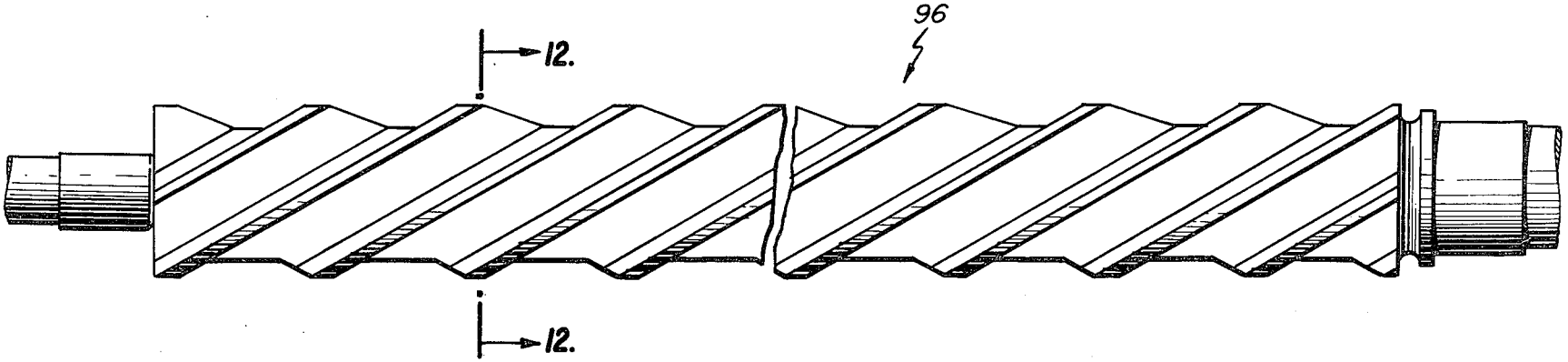
FIG. 9 is a partial view of another cutter which may be used with the present invention.

A modified form of the cutter is shown in FIG. 9 wherein the cutting edges extend helically along the cutter 96 and are of a configuration as shown by the cross sectional view in FIG. 12. Using the helical cutter also provides a variation in the fibrillation which occurs.

During the fibrillation process, the cutter is rotated in the direction of movement of the tape and as mentioned above may be adjusted in speed relative to the speed of the tape which also effects the type and degree of fibrillation.

As will be present, the present invention provides a fibrillator with efficient and variable cutting designs and further substantially eliminates the dust problem which normally exists during fibrillation operations.

The above description and drawings are illustrative only since various equivalent components could be used without departing from the basic inventive concept. Accordingly, the invention is to be limited only by the scope of the following claims.

I claim:

1. A mechanical fibrillator for use in a slit film tape extrusion system comprising means for guiding said tape through said fibrillator;

a rotating cutter rod mounted in said fibrillator;

a plurality of cutting edges extending along the length of said rod;

means for forcing said tape into contact with said rotating cutting edges;

means adjacent said cutter rod for collecting dust created during fibrillation;

said rod having its axis extending across the direction of movement of said tape; and a motor for rotating said rod in the direction of movement of said tape.

2. The fibrillator of claim 1 wherein said cutting surfaces are substantially parallel to the axis of said rod.

3. The fibrillator of claim 1 wherein said cutting surfaces extend helically along the axis of said rod.

4. The fibrillator of claim 1 wherein said means for collecting dust comprises a venturi channel below said rotating cutter means;

a manifold connected to said venturi channel opposite said rotating cutter means; and an air moving system connected to said manifold for creating a suction through said venturi.

5. The fibrillator of claim 1 wherein said means for forcing said tape into contact with said rotating cutter means comprises two substantially parallel plates extending on either side of said rotating cutter means.

6. The fibrillator of claim 5 further comprising means for vertically adjuting the position of said plates relative to said rotating cutter means.

7. The fibrillator of claim 5 further comprising means for laterally adjusting said plates relative to said rotating cutter means.

8. The fibrillator of claim 5 further comprising means for driving said rotating cutter means at different selected speeds.

* * * * *